US007619352B2

(12) United States Patent
Jeurissen et al.

(10) Patent No.: US 7,619,352 B2
(45) Date of Patent: Nov. 17, 2009

(54) FLUORESCENT LAMP AND METHOD FOR MANUFACTURING THE SAME

(75) Inventors: Sven Johannes Jeurissen, Middelburg (NL); Pieter Johannes Wiskerke, Middelburg (NL); Cornelis Aarnoud Peter Joziasse, Middelburg (NL)

(73) Assignee: Koninklijke Philips Electronics N.V., Eindhoven (NL)

( * ) Notice: Subject to any disclaimer, the term of this patent is extended or adjusted under 35 U.S.C. 154(b) by 295 days.

(21) Appl. No.: 10/598,256

(22) PCT Filed: Feb. 21, 2005

(86) PCT No.: PCT/IB2005/050627

§ 371 (c)(1),
(2), (4) Date: Aug. 23, 2006

(87) PCT Pub. No.: WO2005/088677

PCT Pub. Date: Sep. 22, 2005

(65) Prior Publication Data

US 2007/0164677 A1 Jul. 19, 2007

(30) Foreign Application Priority Data

Mar. 4, 2004 (EP) ..... 04100867

(51) Int. Cl.
*H01J 61/02* (2006.01)

(52) U.S. Cl. ..... 313/485; 313/318.02; 313/318.1; 445/17; 445/26; 445/43

(58) Field of Classification Search ..... None
See application file for complete search history.

(56) References Cited

U.S. PATENT DOCUMENTS

| | | | | |
|---|---|---|---|---|
| 3,602,759 | A * | 8/1971 | Evans | 313/112 |
| 3,714,492 | A * | 1/1973 | Roche | 313/485 |
| 4,147,947 | A * | 4/1979 | Hoeh | 313/27 |
| 4,221,453 | A | 9/1980 | Wagener | |
| 5,254,025 | A | 10/1993 | Spaulding et al. | |
| 2003/0155852 | A1 * | 8/2003 | Cunkelman et al. | 313/318.03 |
| 2004/0056581 | A1 * | 3/2004 | Cunkelman et al. | 313/318.01 |

* cited by examiner

*Primary Examiner*—Ashok Patel

(57) ABSTRACT

Fluorescent lamp (1) comprising a glass discharge vessel (2) in which a gas is present, which discharge vessel (2) is on two sides provided with a tubular end portion (3) having a longitudinal axis, which end portion (3) includes a glass stem (5), wherein an exhaust tube (6) extends axially outwardly from said stem (5) for supplying and/or discharging gases during the production of the lamp (1), wherein an electrode (8) extends axially inwardly through the stem (5) for generating and maintaining a discharge in the discharge vessel (2), said electrode (8) comprises two pole wires (9) held in position by the stem (5) and connected to plug pins (11) of an end cap (13) fixed to said end portion (3), characterized in that said end cap (13) is at least substantially made of a shrink material.

12 Claims, 1 Drawing Sheet

FLUORESCENT LAMP AND METHOD FOR MANUFACTURING THE SAME

Figure 1:
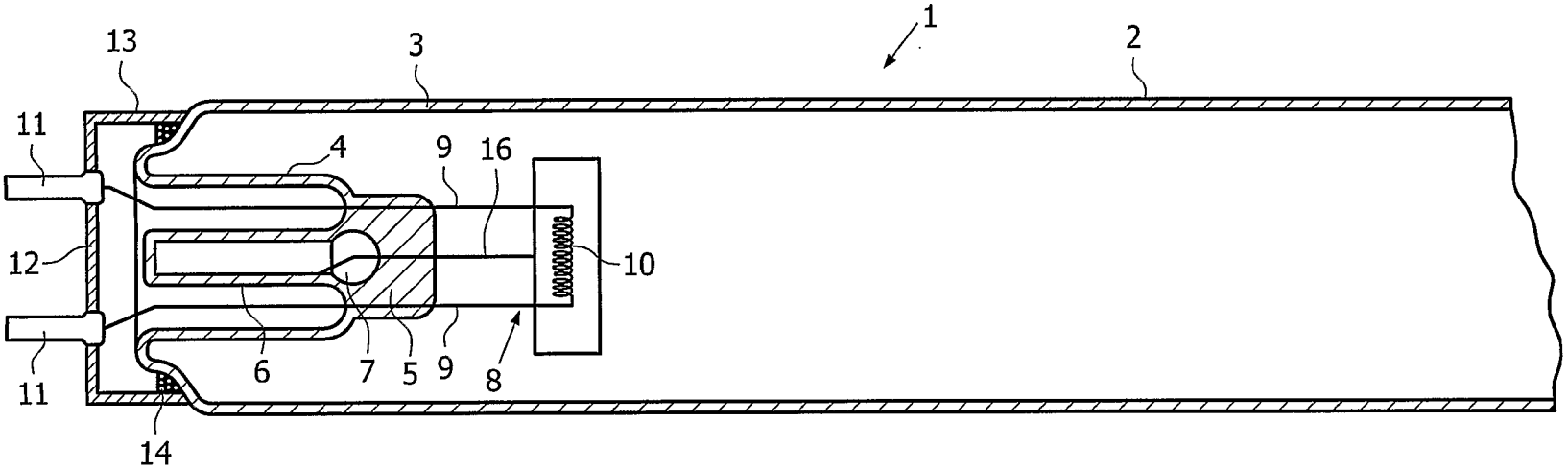

The invention relates to a fluorescent lamp comprising a glass discharge vessel in which a gas is present, which discharge vessel is on two sides provided with a tubular end portion having a longitudinal axis, which end portion includes a glass stem, wherein an exhaust tube extends axially outwardly from said stem for supplying and/or discharging gases during the production of the lamp, and wherein an electrode extends axially inwardly through the stem for generating and maintaining a discharge in the discharge vessel, said electrode comprises two pole wires held in position by the stem and connected to plug pins of an end cap fixed to said end portion. An example of such a fluorescent lamp is the neon tube, mark Philips™, with type number F32T8 (also ALTO™T8), a low-pressure mercury vapour discharge lamp, which is commercially available. The inwardly disposed end of the electrode of said fluorescent lamp is furthermore radially surrounded by a shield for intercepting material being discharged by the electrode, which shield is mounted on an elongated support which extends inwardly from the stem.

In mercury vapour discharge lamps, mercury is the primary component for the (efficient) generation of ultraviolet (UV) light. Present on the inside wall of the discharge vessel is a luminescent film comprising a luminescent material (for example a fluorescent powder) for the purpose of converting UV light to light having other wavelengths, for example UV-A and UV-B for tanning purposes (sun bed lamps), or to visible radiation for general lighting purposes. The discharge vessel for fluorescent lamps usually has a circular cross-section, and it comprises both elongated versions (neon tubes) and compact versions (low-energy lamps). With the neon tube, the aforesaid tubular end portions are in line, forming a long, straight tube; with a low-energy lamp they are interconnected by means of a bent tubular portion or a so-called bridge.

During production, a vacuum is generated in the fluorescent lamp by means of the glass exhaust tubes that are disposed on either end of the lamp. Following that, the desired gas mixture is introduced into the lamp through the same exhaust tubes, after which the exhaust tube ends are squeezed, shut and sealed off.

In use, a voltage is maintained between the electrodes that are likewise disposed at either end of the lamp, as a result of which a continuous discharge takes place and the mercury vapour emits the aforesaid UV light. The ends of the electrodes may be surrounded in radial direction by a shield, because the electrodes regularly discharge small particles in use, which particles would land on the inside of the discharge vessel. This is undesirable, since it leads to a local reduction of the light output, causing the lamp to exhibit an irregular light output, and consequently the particles are intercepted by the shield. The shield that may be present is mounted in the glass stem by means of a wire-like support.

One problem of such a fluorescent lamp is that the metal end caps are glued to the tubular end portions of the discharge vessel, using an expensive glue. The glue is placed into said end cap and is heated up to 270° C. during several minutes in order to achieve a sufficient fixation on the end portion.

The object of the invention is to provide a solid, durable and reliable connection of said end cap to said end portion, avoiding an extra and intricate glueing step of an expensive glue with high processing temperatures, which impedes the use of cheaper low temperature resistant end cap materials.

In order to accomplish that objective, a fluorescent lamp of the kind referred to in the introduction is according to the invention characterized in that said end cap is at least substantially made of a shrink material. Preferably, said shrink material is a heat shrink material. Particularly, use is made of a thermoplastic shrink end cap made of polypropylene, for example.

In one preferred embodiment of a fluorescent lamp in accordance with the invention said heat shrink material is chosen from the group consisting of PVC, polyolefin's, nylon or polyester (like PBT). In particular, said heat shrink material is activated at a temperature varying between 80° and 200° C., preferably between 100° and 150° C.

The invention furthermore relates to a method for manufacturing a fluorescent lamp, wherein a glass discharge vessel is on two sides provided with a tubular end portion having a longitudinal axis, wherein the end portion is provided with a glass stem, wherein an electrode is fitted to extend axially inwardly through the stem for generating and maintaining a discharge in the discharge vessel, wherein an exhaust tube is fitted to extend axially outwardly from said stem, through which exhaust tube the discharge vessel is filled with a gas, and wherein two pole wires of said electrode are held in position by the stem and are connected to plug pins of an end cap fixed to said end portion, characterized in that said end cap is fixed to said end portion through shrinking, preferably heat shrinking.

Figure 2:
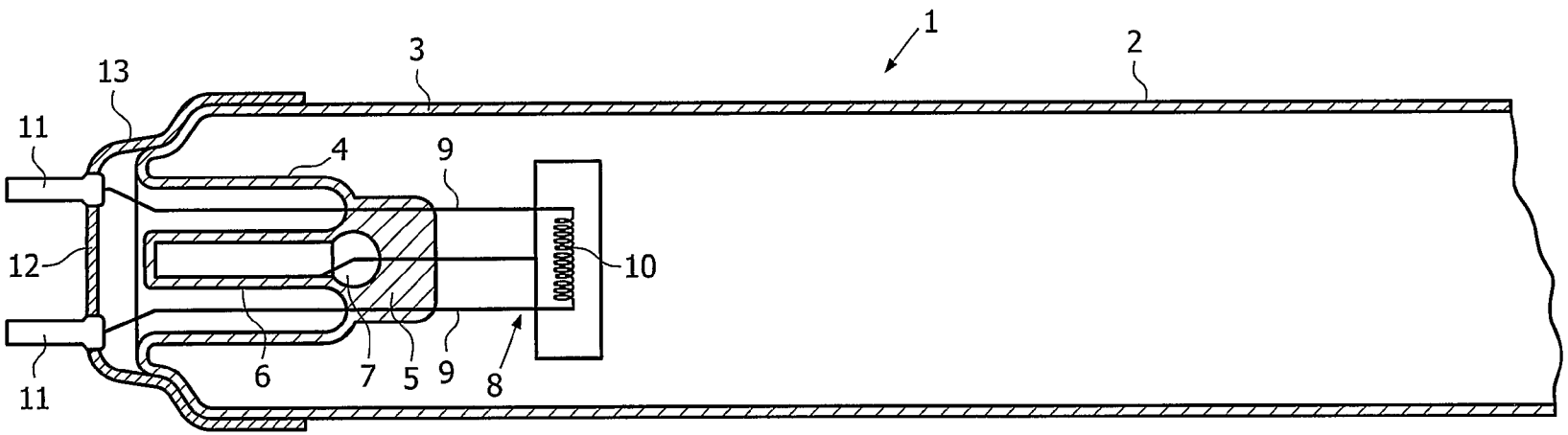

The invention will now be explained in more detail by means of exemplary embodiments as shown in the figures, wherein:

FIG. 1 is a partial cross-sectional view of a fluorescent lamp according to the prior art; and FIG. 2 is a partial cross-sectional view of a fluorescent lamp in accordance with the invention.

According to FIG. 1, a prior art fluorescent lamp I comprises a glass discharge vessel in the form of a tube 2. The figure only shows the end portion 3 of lamp 1, in actual fact the lamp comprises two opposing, identical end portions 3, which each close one side of a long glass tube 2. Present on the inside of glass tube 2 is a film of a fluorescent material, which is capable of converting UV light into UV-A light, UV-B light or visible light.

Glass tube 2 comprises an inwardly extending cylindrical support 4 at its end, on which a stem 5 (also called "pinch") is mounted after pole wires 9 and support 4 have been melted therein. An outwardly extending, tubular exhaust tube 6 is mounted on stem 5, which tube is in open communication with the contents of tube 2 via a hole 7 in stem 5. Before final assembly of the lamp 1 takes place, a vacuum is generated in tube 2 by the exhaust tube 6, which will have an even greater length than illustrated in that condition, and tube 2 is filled with the desired (inert) gas mixture. Furthermore, an amount of mercury is introduced into the lamp. Following that, the exhaust tube 6 is heated, causing the glass to soften, squeezed, shut and sealed off, so that tube 2 is sealed airtight.

Lamp 1 furthermore comprises an electrode 8 on either side, which electrode comprises two pole wires 9 and a tungsten spiral wire 10. Spiral wire 10 is coated with a film of an emitter material (containing, among other substances, barium, strontium, calcium and various oxides), which functions to stimulate the emission of electrons. The pole wires 9 are held in position by the stem 5, in which the wires are melted near the sides thereof, which wires are furthermore connected to plug pins 11. Plug pins 11 are held in position in an electrically insulating disc 12, which forms part of a metal end cap 13. End cap 13 is fixed to the glass tube by means of an annular film of glue 14.

Plug pins 11 can be inserted into a lamp fitting, which supplies lamp 1 with current. The resulting discharge between electrodes 8 causes the mercury vapour molecules to emit UV light, which is converted into light having the desired wavelenght(s) by the fluorescent film on the inside wall of tube 2.

FIG. 2 shows a partial cross-sectional view of a fluorescent lamp 1 of the invention, wherein FIG. 2 corresponds to FIG. 1 in the sense that like parts are indicated by the same reference numerals.

According to the invention, the end cap 13 is no metal cap being glued to the glass tube 2. Instead the end cap 13 is made of a heat shrinking material, such as polypropylene. Fixation of said end cap 3 to said tube 2 is then realized by heating said end cap 13 in its operational position, resulting in shrinking of said PP material and thus in a solid, durable and reliable fixation. Glueing is thus avoided, whereas the heat shrinking temperature varying between 100° and 150° C. is much lower than the glueing temperature of approximately 270° C. according to the prior art. The invention enables a quick, clean and easy assembly of said end cap 13, wherein the end caps 13 can be made in any desired shape and/or color through a low cost manufacturing process, such as injection ("stretch blow") moulding or vacuum (thermo) forming of heat shrink material in the desired pre-shape.

It will be apparent that within the scope of the invention many variations are possible for a person skilled in the art.

The scope of the invention is not limited to the exemplary embodiments described herein. The invention is embodied in every novel feature and every combination of features. The numerals that are mentioned in the claims do not limit the scope thereof. The use of the word "comprise" does not exclude the presence of elements other than those mentioned in the claims. The use of the word "a" or "an" before an element does not exclude the presence of a multitude of such elements.

The invention claimed is:

1. A fluorescent lamp comprising:

a glass discharge vessel in which a gas is present, which discharge vessel is on two sides provided with a tubular end portion having a longitudinal axis, which end portion includes a glass stem, wherein:

an exhaust tube extends axially outwardly from the stem for supplying and/or discharging gases during the production of the lamp, an electrode extends axially inwardly through the stem for generating and maintaining a discharge in the discharge vessel, the electrode including two pole wires held in position by the stem and connected to plug pins of an end cap fixed to the end portion, and the end cap is at least substantially made of a shrink material.

2. The lamp of claim 1, wherein the shrink material is a heat shrink material.

3. The lamp of claim 2, wherein the heat shrink material is chosen from the group consisting of PVC, polyolefins, nylon, and polyester.

4. The lamp of claim 2 or 3, wherein the heat shrink material is activated at a temperature varying between 80° and 200° C.

5. The lamp of claim 3, wherein the heat shrink material is activated at a temperature varying between 100° and 150° C.

6. The lamp of claim 2, wherein the heat shrink material is activated at a temperature varying between 100° and 150° C.

7. A method for manufacturing a fluorescent lamp, comprising:

providing a glass discharge vessel that includes at least a tubular end portion having a longitudinal axis, wherein the end portion is provided with a glass stem, an electrode is fitted to extend axially inwardly through the stem for generating and maintaining a discharge in the discharge vessel, and an exhaust tube is fitted to extend axially outwardly from the stem, filling the discharge vessel through the exhaust tube with a gas, connecting two pole wires of the electrode that are held in position by the stem to plug pins of an end cap that is made substantially of a shrinkable material, and fixing the end cap to the end portion by shrinking the end cap.

8. The method of claim 7, wherein the shrinking includes heat shrinking.

9. The method of claim 8, wherein the end cap is made substantially of a heat shrink material.

10. The method of claim 9, wherein the heat shrink material is chosen from the group consisting of PVC, polyolefins, nylon, and polyester.

11. The method of claim 8, wherein the shrinking is performed at a temperature varying between 80° and 200° C.

12. The method of claim 8, wherein the shrinking is performed at a temperature varying between 100° and 150° C.

* * * * *